US005965980A

United States Patent [19]

Hagiwara et al.

[11] Patent Number: 5,965,980

[45] Date of Patent: Oct. 12, 1999

[54] MATRIX-ADDRESSED ELECTROLUMINESCENT DISPLAY DEVICE PANEL WITH ORTHOGONALLY PROVIDED UPPER AND LOWER ELECTRODES, PASSIVATION LAYERS, AND TERMINALS ON ONE SIDE OF SUBSTRATE

[75] Inventors: Takashi Hagiwara, Chiryu; Youiti Kotanchi; Yutaka Hattori, both of Okazaki, all of Japan

[73] Assignee: Denso Corporation, Kariya, Japan

[21] Appl. No.: 08/903,884

[22] Filed: Jul. 31, 1997

[30] Foreign Application Priority Data

Aug. 8, 1996 [JP] Japan ..... 8-210213

[51] Int. Cl.[6] ..... H01J 1/62

[52] U.S. Cl. ..... 313/506; 313/500; 313/318.06; 315/169.3

[58] Field of Search ..... 313/500, 506, 313/318.06; 315/169.3

[56] References Cited

FOREIGN PATENT DOCUMENTS 60-089098 5/1985 Japan .

2-091618 3/1990 Japan .

4-043995 10/1992 Japan .

*Primary Examiner*—Sandra O'Shea

*Assistant Examiner*—Ronald E. DelGizzi

*Attorney, Agent, or Firm*—Pillsbury Madison & Sutro LLP

[57] ABSTRACT

A matrix-addressed electroluminescent display panel has lower electrodes and back electrodes orthogonally provided with each other through a luminescent layer and the like. A passivation layer is formed on the back electrodes on an opposite side of the lower electrodes with respect to the back electrodes, and back electrode leading members are formed on the passivation layer on an opposite side of the back electrodes with respect to the passivation layer to be electrically connected to the back electrodes. The lower electrodes have ends arranged on one side of a substrate, and the back electrode leading members are formed to have ends arranged on the same side of the substrate as the ends of the lower electrodes. Accordingly, terminals of the lower and back electrodes can be arranged on one side of the substrate, thereby preventing increase of the size of the display panel.

20 Claims, 7 Drawing Sheets

MATRIX-ADDRESSED ELECTROLUMINESCENT DISPLAY DEVICE PANEL WITH ORTHOGONALLY PROVIDED UPPER AND LOWER ELECTRODES, PASSIVATION LAYERS, AND TERMINALS ON ONE SIDE OF SUBSTRATE

CROSS REFERENCE TO RELATED APPLICATION

This application is based upon and claims the benefit of priority of the prior Japanese Patent Application No. 8-210213, filed on Aug. 8, 1996, the contents of which are incorporated herein by reference.

BACKGROUND OF THE INVENTION

1. Field of the Invention

The present invention relates to a matrix-addressed display device, such as an electroluminescent (EL) display device.

2. Related Arts

A typical matrix-addressed EL display device as shown in FIG. 11, has a glass substrate 1 on which a stack of lower electrodes 2, a first insulating layer 3, a luminescent layer 4, a second insulating layer 5, and upper electrodes (back electrodes) 6 are formed, in that order. The lower and back electrodes 2 and 6 are data electrodes and scanning electrodes, respectively, and are orthogonally disposed to each other. Each lower electrode 2 has a strip-like shape with a terminal 7*a* at an end thereof. Each back electrode 6 has a strip-like shape with a terminal 7*b* at an end thereof. The terminals 7*a* and 7*b* of the lower and back electrodes 2 and 6 are arranged on at least two side of the glass substrate 1.

The areas where the terminals 7*a* and 7*b* are formed cannot function as display areas. Therefore, forming the terminals 7*a* and 7*b* on multiple sides of the glass substrate 1 requires a larger size of the EL display device. To solve this problem, Japanese Utility Model Publication No. 4-43995 proposes a matrix-addressed EL display device having through-holes, which are formed in non-intersecting portions between back electrodes and lower electrodes and which penetrate a luminescent layer and the like interposed to permit communication between the back electrodes and the lower electrodes. The EL display device further has lower electrode leading strips formed on the same plane as the back electrodes between the back electrodes adjacent to each other and electrically connected to the lower electrodes through the through-holes.

In the above-mentioned EL display device, however, forming the through-holes on the non-intersecting portions (non-pixel portions) between the lower and back electrodes gives rise to the following problems. For example, the manufacturing process becomes complicated, and the manufacturing costs are increased. In addition, because the lower electrode leading strips are formed between the back electrodes adjacent to each other, it is difficult to obtain a sufficient width lower electrode leading strips. Especially when the lower electrode leading strips are made of optically transparent material, the insufficient width of the lower electrode leading strips causes the problem that the wire resistance of each lower electrode leading strip increases.

Japanese Patent Application Laid Open No. 2-91618 discloses a matrix-addressed liquid crystal display device in which one set of X and Y electrodes, corresponding to back and lower electrodes, are electrically connected to leading wires which extend from portions thereof, corresponding to non-pixel portions, in parallel with another of the sets of the X and Y electrodes. In this case, there is a problem that the leading wires have to be connected to the one of the sets of X and Y electrodes at the portions corresponding to non-pixel portions of the liquid crystal display, thereby restricting the widths of the one of the sets of X and Y electrodes.

SUMMARY OF THE INVENTION

The present invention has been made in view of the above-mentioned problems and an object of the present invention is to provide a matrix-addressed display device including electrodes and leading members electrically connected to the electrodes with an arrangement capable of decreasing the number of sides of substrate on which terminals of the electrodes are arranged and having high flexibility of forming the leading members.

According to the present invention, a matrix-addressed display device has a substrate. On the substrate, first electrodes having parallel strips with ends arranged close to a first side of the substrate, and second electrodes having parallel strips and orthogonally provided relative to the first electrodes, are formed to define pixels at intersections between the first and second electrodes. Further, a second electrode passivation layer is provided on a surface of the second electrodes on an opposite side of the first electrodes, with respect to the second electrode and second electrode leading members are provided on a surface of the second electrode passivation layer on an opposite side of the second electrodes with respect to the second electrode passivation layer. The second electrode leading members are electrically connected to the second electrodes so as to be disposed perpendicularly relative to the second electrode, and ends thereof are arranged close to the first side of the substrate. The ends of the first electrodes and the ends of the second electrode leading members, which are arranged close to the first side of the substrate, are connected to first and second terminals, respectively.

Therefore, even if the first and second electrodes are orthogonally provided with respect to each other, the first and second terminals connected to the first and second electrodes, respectively, can be arranged on one side of the substrate by arranging the second electrode leading members, thereby preventing increase of the size in display device. In addition, the second electrode leading members are provided on the surface of the second electrode passivation layer on the opposite side of the second electrodes with respect to the second electrode passivation layer. Therefore, the second electrode leading members can be arranged with high flexibility regardless of the location of the pixels.

The second electrode passivation layer may have through-holes. In this case, the second electrode leading members can be electrically connected to the second electrodes through the through-holes. The second electrode leading members may be electrically connected to the second electrodes at a circumferential side of the second electrode passivation layer without using the through-holes.

In the case where the first electrodes are divided into first and second groups of first electrodes substantially in parallel with the first side of the substrate so that the first group of the first electrodes are provided close to the first side of the substrate and the second group of the first electrodes are provided close to a third side of the substrate opposite to the first side, a first electrode passivation layer is provided on a surface of the first electrodes on an opposite side of the second electrodes with respect to the first electrodes.

Further, first electrode leading members are provided on a surface of the first electrode passivation layer on an opposite side of the first electrodes with respect to the first electrode passivation layer. The first electrode leading members are electrically connected to the second group of the first electrodes and have ends thereof arranged close to the first side of the substrate.

The ends of the first electrode leading members are connected to third terminals on the first side of the substrate.

Therefore, even if the first electrodes are divided into two groups of electrodes, the terminals of the two groups of the first electrodes can be arranged on one side of the substrate. Further, by adopting the first and second electrode leading members together, the terminals of the first electrodes and the second electrodes can be arranged on one side of the substrate.

The first electrode leading members can be electrically connected to the first electrodes via through-holes formed in the first electrode passivation layer, and otherwise at a circumferential side of the first electrode passivation layer without using the through-holes in the same way as the second electrode leading members. When the former way using the through-holes is employed, the length of the leading members can be decreased compared to the latter way, resulting in low wire resistances of the leading members.

BRIEF DESCRIPTION OF THE DRAWINGS

Other objects and features of the present invention will become more readily apparent from a better understanding of preferred embodiments described below with reference to the following drawings.

DETAILED DESCRIPTION OF CURRENTLY PREFERRED EMBODIMENTS

Embodiments according to the present invention will be described hereinunder with reference to the drawings.

Figure 1:
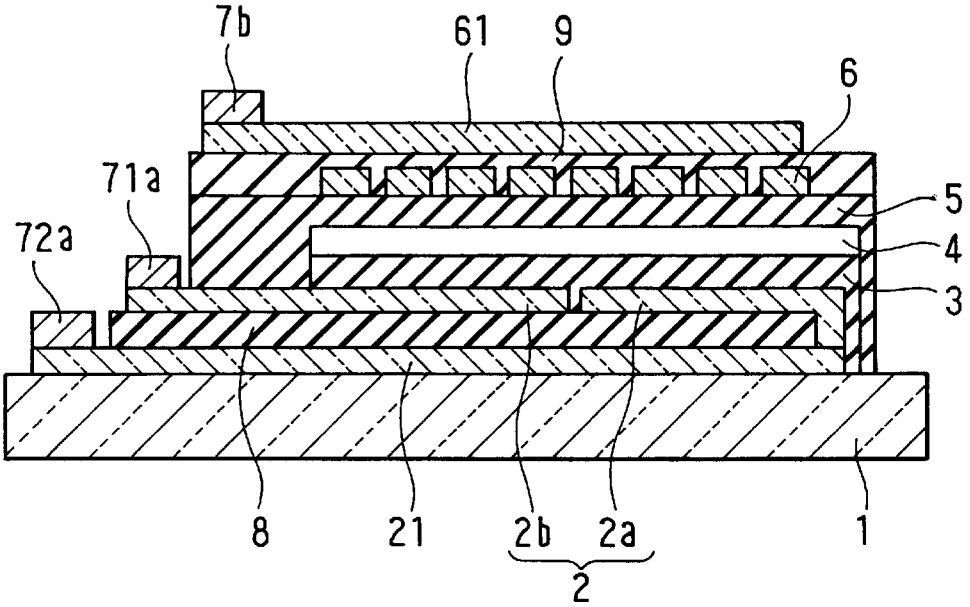
FIG. 1 is a cross-sectional view showing an EL display device in a first embodiment according to the present invention.
Figure 2:
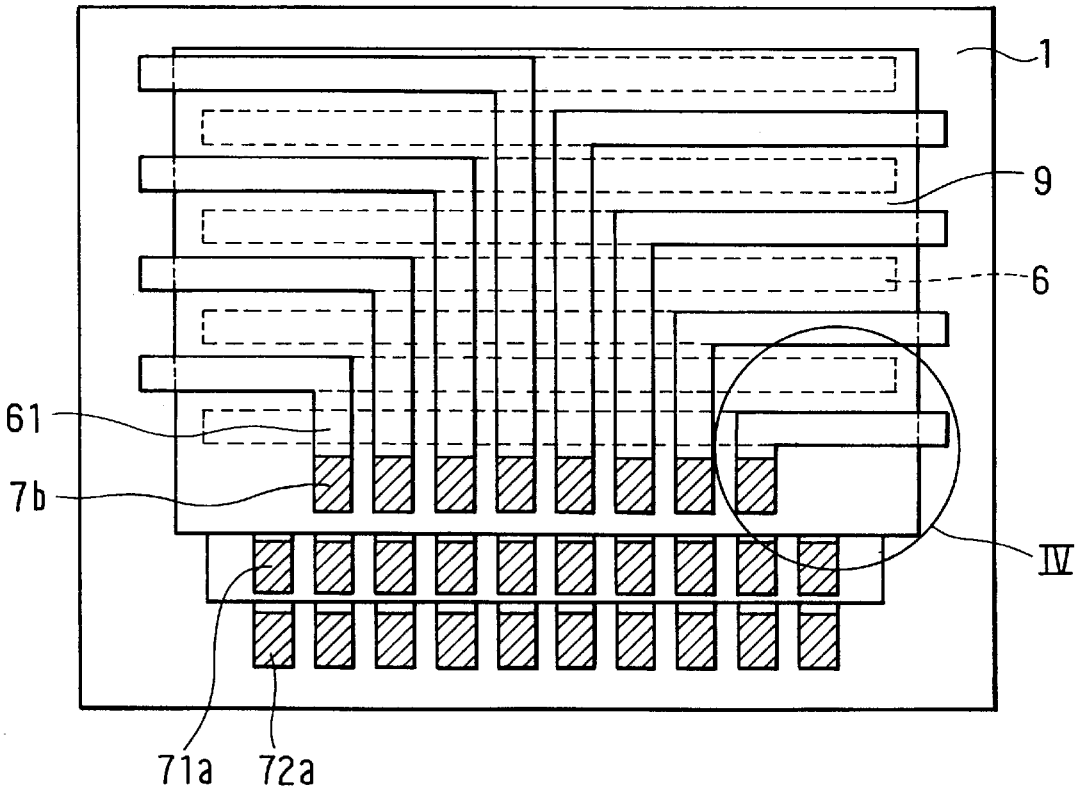
FIG. 2 is a plan view showing the EL display device in the first embodiment.
Figure 3:
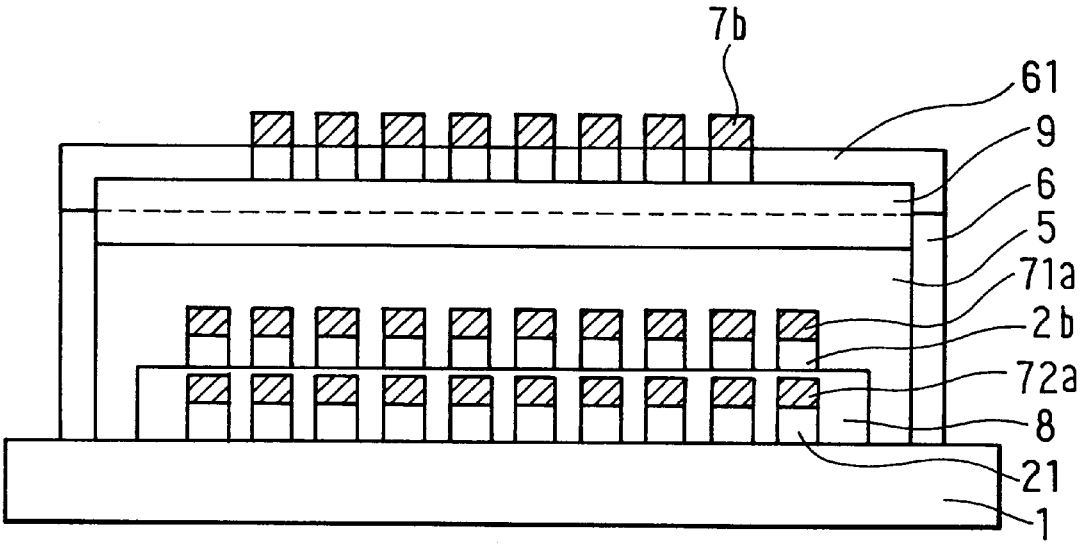
FIG. 3 is a side view showing the EL display device in the first embodiment.

In a matrix-addressed EL display device according to first embodiment, as shown in FIGS. 1, 2, and 3, lower electrode leading strips 21 having a strip-like shape corresponding to lower electrodes 2 are formed on a glass substrate 1. A passivation layer 8 is formed on the lower electrode leading strips 21. Formed on the passivation layer 8 are the lower electrodes 2. The lower electrodes 2 are divided into two groups of lower electrodes 2*a* and 2*b* in order to divide a screen into two display areas, and the lower electrode leading strips 21 are electrically connected to the lower electrodes 2*a* at a circumferential side of the first passivation layer 8, as shown in FIG. 1.

Figure 4:
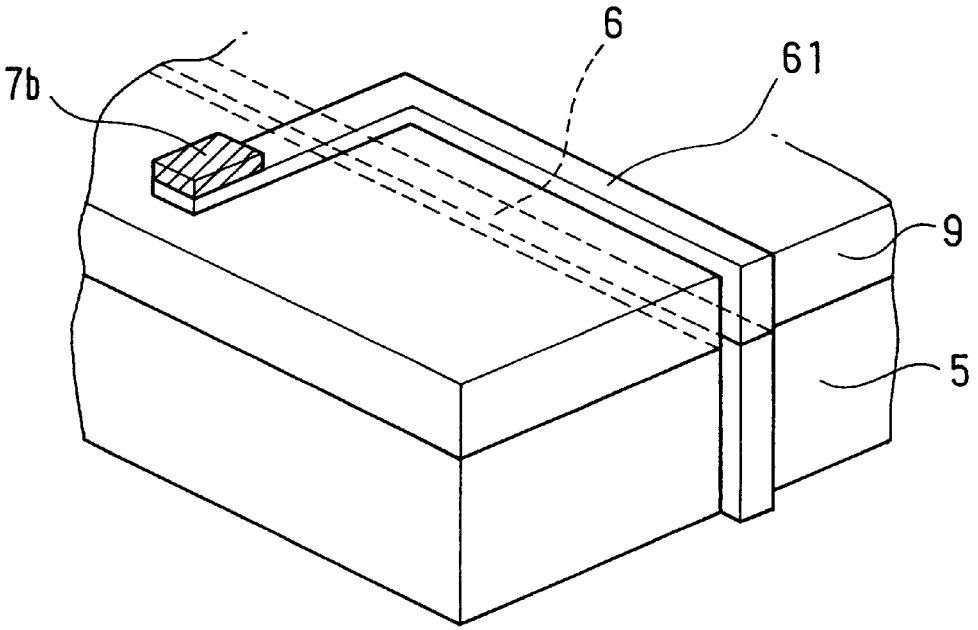
FIG. 4 is a fragmentary enlarged perspective view of a portion surrounded by a circle IV in FIG. 2.

On the lower electrodes 2, a first insulating layer 3, a luminescent layer 4, a second insulating layer 5, and a back electrodes 6 are formed in that order. Further, a passivation layer 9 is formed on the back electrodes 6, and back electrode leading strips 61 are formed on the passivation layer 9 with a pattern shown in FIG. 2 to be electrically connected to the back electrodes 6 at circumferential sides of the second passivation layer 9 as shown in FIG. 4. Each of the glass substrate 1, the lower electrode leading strips 21, the first passivation layer 8, the lower electrodes 2, the first insulating layer 3, the luminescent layer 4, the second insulating layer 5, the back electrodes 6, the passivation layer 9, and the back electrode leading strips 61 are made of optically transparent material, so that light can exit from the upper surface and the lower surface of the display device.

The lower electrode 2*b* have terminals 71*a* at the ends thereof, respectively, to be aligned on one side of the glass substrate 1 (on the left side in FIG. 1). Further, the lower electrode leading strips 21 have terminals 72*a* at the ends thereof, respectively, to be aligned on the same side of the glass substrate 1 as the terminals 71*a* of the lower electrodes 2*b*. Accordingly, even if each of the lower electrodes 2 is divided into two groups of the electrodes 2*a* and 2*b*, the terminals 71*a* and 72*a* of the lower electrodes 2*a* and 2*b* can be arranged on the same side of the glass substrate 1. In addition, each end of the back electrode leading strips 61 having a terminal 7*b* is formed on the same side of the glass substrate 1 as the terminals 71*a* and 72*a* of the lower electrodes 2*b* and the lower electrode leading strips 21. That is, all the terminals 71*a*, 72*a*, and 7*b* can be arranged on one side of the glass substrate 1.

Figure 5A:
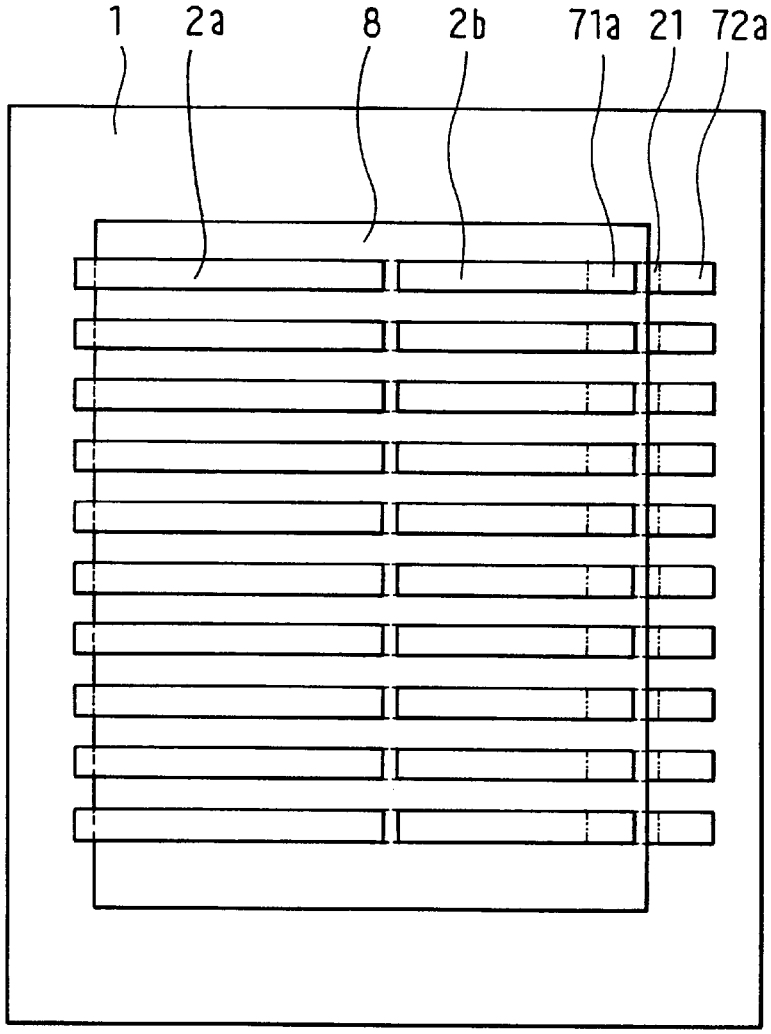
FIG. 5A is a plan view for explaining a process of producing the EL display device in the first embodiment.
Figure 5B:
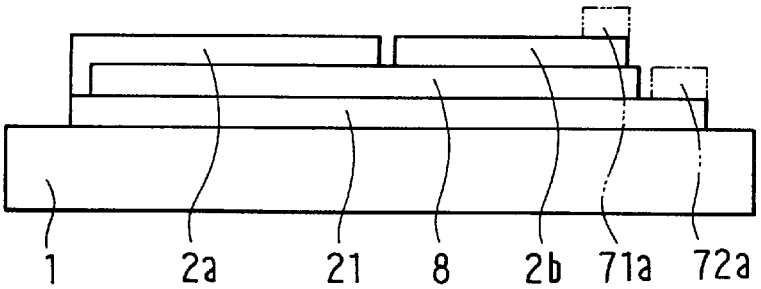
FIG. 5B is a side view showing the device in FIG. 5A.

Next, a method of producing the above-mentioned EL display device will be described referring to the figures. First, a transparent conductive layer made of indium tin oxide (ITO) or the like is deposited on the glass substrate 1, and then, patterned to form the lower electrode leading strips 21. Thereafter, the first passivation layer 8, which is made of an insulating material, such as silicon oxynitride (SiON) or the like, is formed on the glass substrate 1 through the lower electrode leading strips 21 so that both ends of each lower electrode leading strip 21 are exposed. Next a transparent conductive layer made of ITO or the like is deposited on the first passivation layer 8, and patterned to form the lower electrodes 2*a* and 2*b*. In this case, each end of the lower electrodes 2*a* is formed to make contact with each end of the lower electrode leading strips 21 on one side of the glass substrate (on a left side in FIGS. 5A and 5B), thereby forming the structure shown in FIGS. 5A and 5B.

Figure 6A:
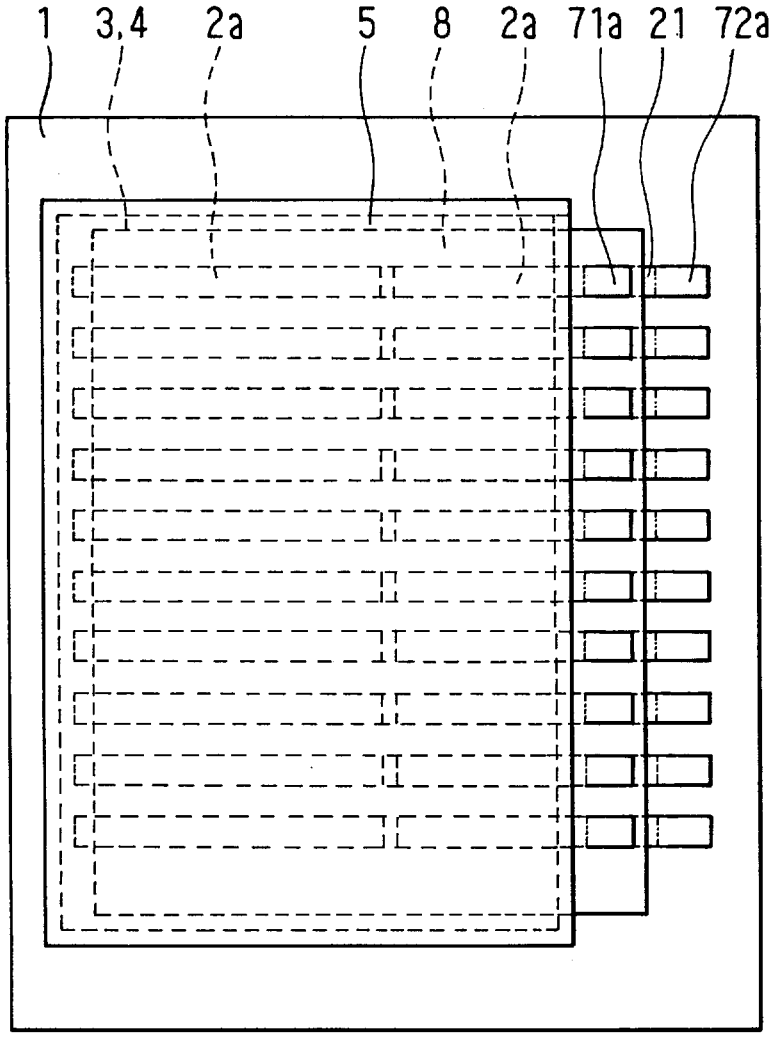
FIG. 6A is a plan view for explaining a process of producing the EL display device, subsequent to the process shown in FIGS. 5A and 5B.
Figure 6B:
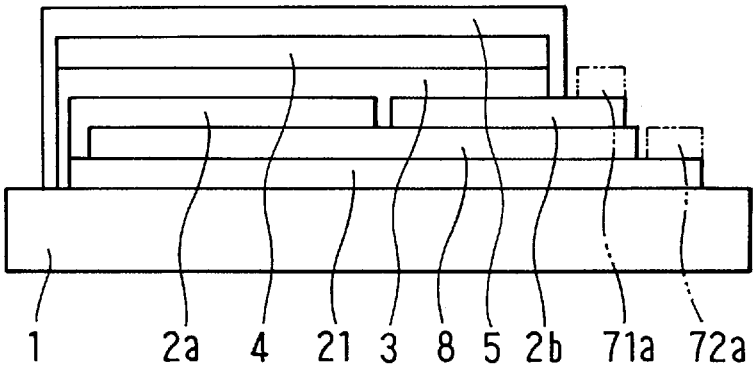
FIG. 6B is a side view showing the device in FIG. 6A.

Next, the first insulating layer 3, the luminescent layer 4, and the second insulating layer 5 are formed on the lower electrodes 2 in that order by conventional methods, thereby forming the structure shown in FIGS. 6A and 6B. Thereafter, a transparent conductive layer made of ITO or the like is formed on the second insulating layer 5 and patterned to form the back electrodes 6, having a strip-like shape and extending perpendicularly with respect to the lower electrodes 2. In this case, the back electrodes 6 are formed so that its ends alternately protrude on two sides, opposite each other, of the glass substrate 1, of shown in FIG. 2. Then the second passivation layer 9, which is made of insulating material, such as SiON, is formed on the back electrodes 6 so that the protruding ends of the back electrodes 6 are exposed.

Figure 7:
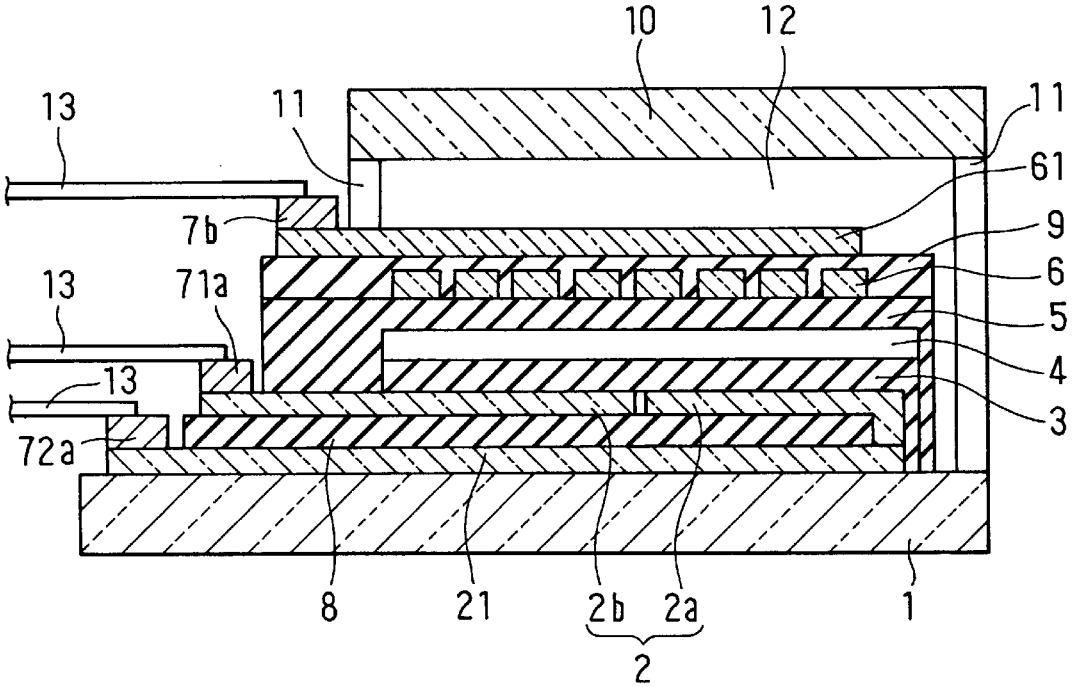
FIG. 7 is a cross-sectional view showing the EL display device to which a dummy glass is attached.
Figure 8:
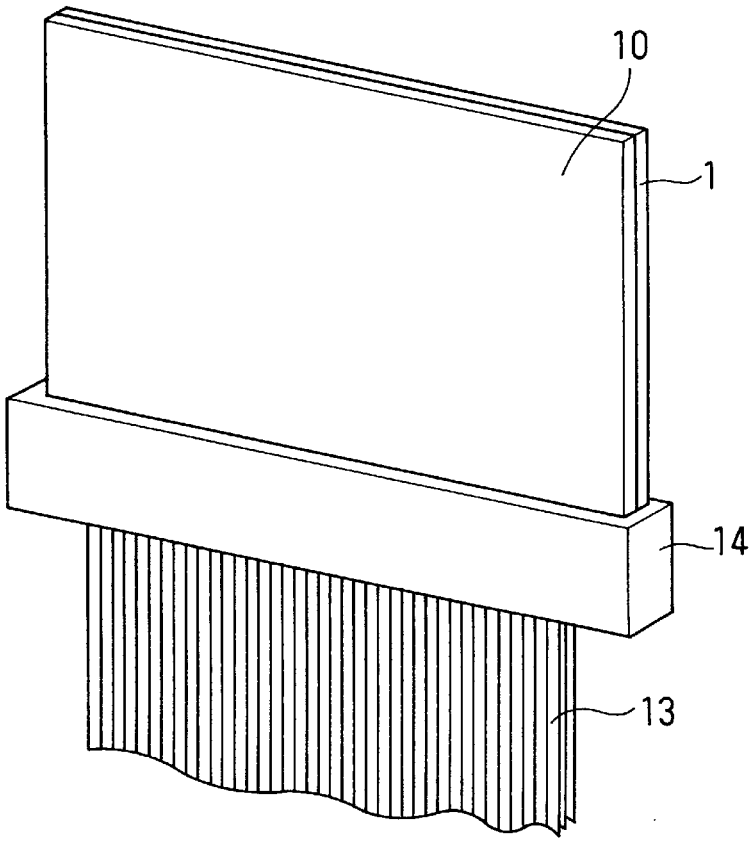
FIG. 8 is a schematically perspective view showing the external appearance of an EL display device.

Next a transparent conductive layer made of ITO or the like is deposited on the second passivation layer 9 and patterned to form the back electrode leading strips 61, having the arrangement shown in FIG. 2. In this case, as shown in FIGS. 2 and 4, the end of each back electrode leading strip 61 contacts the exposed end of each back electrode 6, and the other end of each back electrode leading strips 61 is arranged on the side on which the ends of the lower electrode leading strips 21 and the lower electrodes 2*b* are arranged. Then, the terminals 71*a*, 72*a*, and 7*b* are formed on the ends of the lower electrodes 2*b*, the lower electrode leading strips 21, and the back electrode leading strips 61, respectively. The terminals 71*a*, 72*a*, and 7*b* are made of metallic material, such as nickel (Ni) or the like. Thereafter, as shown in FIG. 7, a dummy glass 10 made of the same material as the glass substrate 1 is attached to the device shown in FIGS. 6A and 6B by adhesive 11 to define a space. This space is filled with sealing material 12, such as silicone oil or the like. Leading wires 13 to be connected to a drive circuit are connected to the terminals 71*a*, 72*a*, and 7*b*. Finally, as shown in FIG. 8, the connected portions of the terminals 71*a*, 72*a*, and 7*b* with the leading wires 13 are covered with a case 14, thereby completing the EL display device.

According to the first embodiment, all the terminals 71*a*, 72*a*, and 7*b* of the lower electrodes 2*a* and 2*b*, and the back electrodes 6 are arranged on one side of the glass substrate 1. Therefore, the connected portions of the terminals 71*a*, 72*a*, and 7*b* with the leading wires 13 can be formed on the side of the glass substrate 1. Because of this, the case 14 for covering the connected portions is attached to only one side of the glass substrate 1, so that the area other than the connected portions covered with the case 14 can perform as the display area. As a result, the display device can be miniaturized.

In the first embodiment, the lower electrode leading strips 21 and the back electrode leading strips 61 are electrically connected to the lower electrodes 2 and the back electrodes 6 at the circumferential sides of the first and second passivation layers 8 and 9, respectively. However, the lower electrode leading strips 21 and the back electrode leading strips 61 may be electrically connected to the lower electrodes 2 and the back electrodes 6 via through-holes formed in the first and second passivation layers 8 and 9.

Figure 9A:
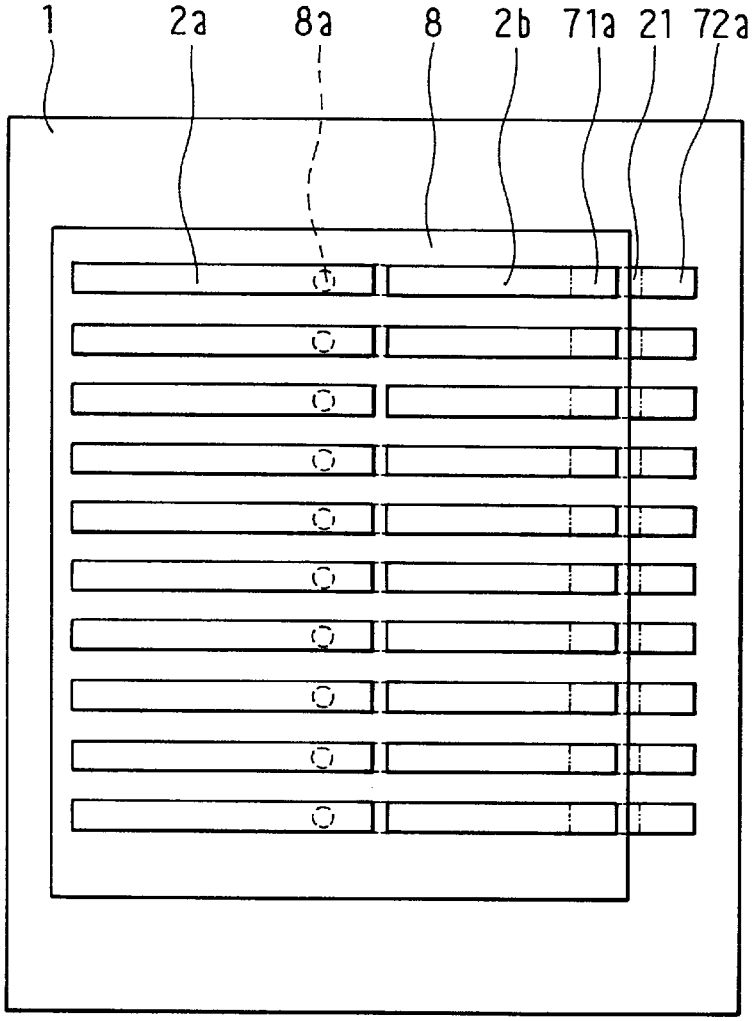
FIG. 9A is a plan view for explaining a process of producing an EL display device in a second embodiment.
Figure 9B:
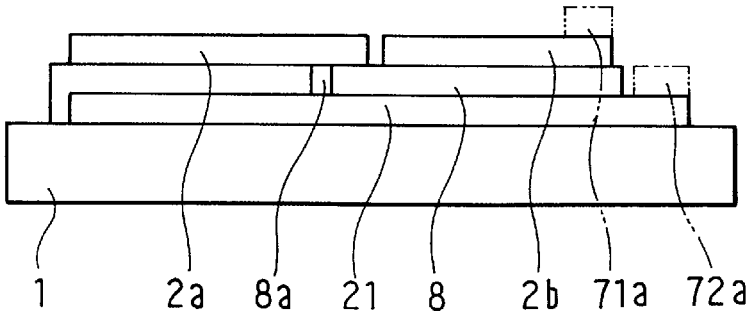
FIG. 9B is a side view showing the device in FIG. 9A.
Figure 10:
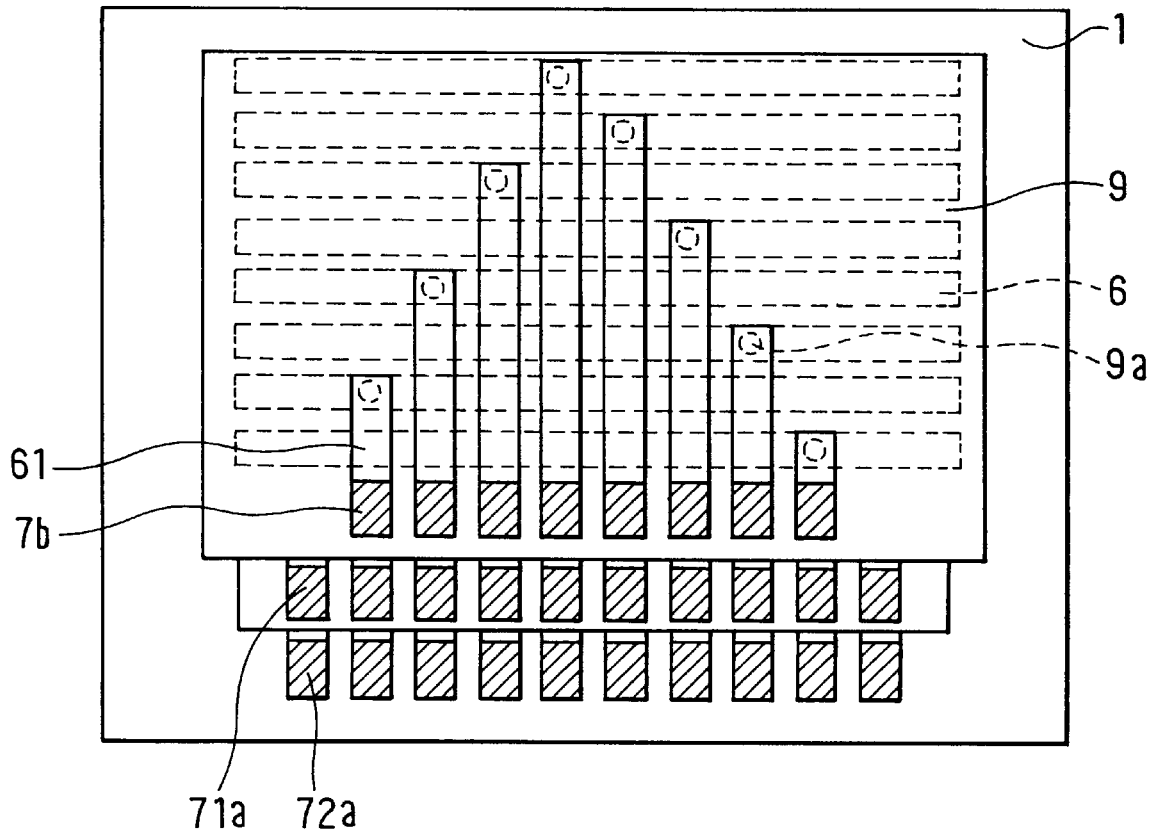
FIG. 10 is a plan view for explaining a process of producing the EL display device, subsequent to the process shown in FIGS. 9A and 9B in the second embodiment.
Figure 11:
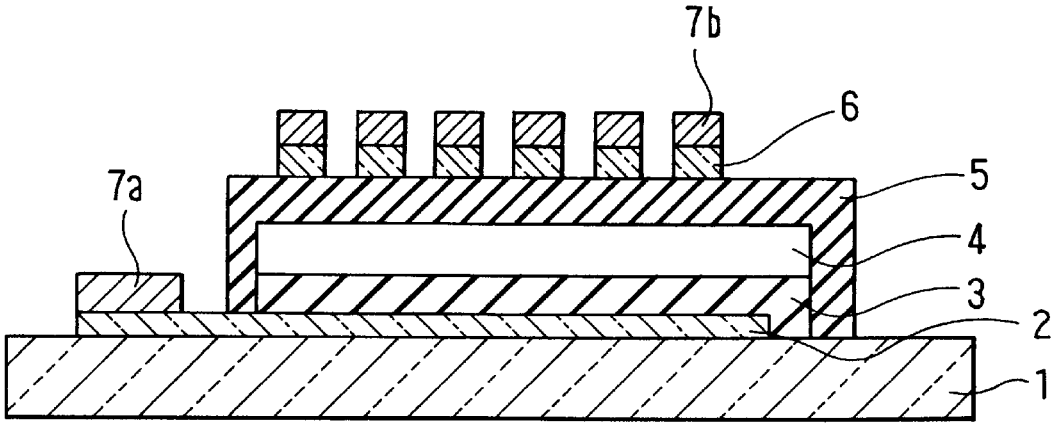
FIG. 11 PRIOR ART
FIG. 11 is a cross-sectional view showing an EL device according to prior art.

That is, the first passivation layer 8 is formed with through-holes 8*a*, as shown in FIGS. 9A and 9B. When the lower electrodes 2 are formed, the electrodes 2*a* are electrically connected to the lower electrode leading strips 21 via the through-holes 8*a*. The second passivation layer 9 is also formed with through-holes 9*a*, as shown in FIG. 10. The back electrode leading strips 61 are electrically connected to the back electrodes 6 via the through-holes 9*a* when formed, as well.

In a second embodiment, it is not necessary that the lower electrodes 2*a* and the lower electrode leading strips 21, and the back electrodes 6 and the back electrode leading strips 61 are connected at the circumferential sides of the first and second passivation layers 8 and 9. Therefore, the length of the lower electrode leading strips 21 and the back electrode leading strips 61 can be decreased compared to those in the first embodiment, resulting in lower wire resistances thereof.

While the present invention has been shown and described with reference to the foregoing preferred embodiments, it will be apparent to those skilled in the art that changes in form and detail may be made therein without departing from the scope of the invention as defined in the appended claims.

For example, in the first and second embodiments, although the lower electrode leading strips 21 are formed in parallel with the lower electrodes 2*a* and 2*b*, the lower electrode leading strips 21 may have the other patterns, provided that the ends of the lower electrode leading strips 21 are arranged on the same side of the glass substrate 1 as the ends of the lower electrodes 2*b*. Similarly, it is not necessary that the back electrode leading strips 61 are bent perpendicularly with respect to the longitudinal direction of the back electrodes 6 to form the pattern shown in FIG. 2. The back electrode leading strips 61 may have the other patterns, provided that the ends of the back electrode leading strips 61 are aligned on the side of the glass substrate 1, which is perpendicular to the longitudinal direction of the back electrodes 6. In a case where the lower electrode leading strips 21 are formed just below the lower electrodes 2, unevenness becomes large. Therefore, it is desired that the position of the pattern of the lower electrode leading strips 21 is shifted from that of the lower electrodes 2.

Further, in the first and second embodiments, the present invention was applied to the matrix-addressed EL display device in which the terminals of the lower and back electrodes are arranged on four sides of the glass substrate according to the prior art. In the first and second embodiments, by adopting the lower and back electrode leading strips 21 and 61 to the EL display device, all the terminals 71*a*, 72*a* and 7*b* of the lower electrodes 2*a* and 2*b*, and the back electrode 6 are formed on the same side of the glass substrate 1. However, only one of the lower electrode leading strips 21 and the back electrode leading strips 61 may be adopted to the EL display device. In the case where only the lower electrode leading strips 21 are adopted, the terminals 71*a*, 72*a* and 7*b* are arranged on three sides of the glass substrate 1, and in the case where only the back electrode leading strips 61 are adopted, the terminals 71*a*, 72*a* and 7*b* are arranged on two sides of the glass substrate 1.

In the above-mentioned EL display device, the back electrodes 6 are formed so that the ends thereof to be connected to the back electrode leading strips 61 are alternately provided on two sides opposite to each other of the glass substrate 1, as shown in FIG. 2. However, the ends of the back electrodes 6 to be connected to the back electrode leading strips 61 may be arranged on one side of the glass substrate 1. In such case, when only one of the lower electrode leading strips 21 and the back electrode leading strips 61 are employed, in either cases, the terminals 71*a*, 72*a* and 7*b* can be arranged on two sides of the glass substrate 1.

Further, the present invention can be applied to another EL display device in which the terminals of lower and back electrodes are arranged on two sides of a glass substrate without forming any lower and back electrode leading wires. In this case, by adopting only one of the lower and back electrode leading strips, the terminals of the lower and back electrodes can be arranged on one side of the glass substrate.

In the first and second embodiments, although only the lower electrodes 2 are divided into two groups of the lower electrodes 2*a* and 2*b*, simultaneously the back electrodes 6 may be divided into two groups of the back electrodes. In this case, by adopting another passivation layer and another back electrode leading strips, all terminals of the lower and back electrodes can be arranged on one side of the glass substrate as well. Here, it is apparent that the present invention can be applied to the other matrix-addressed display devices, such as a liquid crystal display device and the like.

Variations such as those described above are to be understood as being within the scope of the present invention as defined by the appended claims.

What is claimed is:

1. A matrix-addressed display device, comprising:

a substrate including a plurality of elements disposed thereon, said elements comprising:

a plurality of first electrodes having a plurality of parallel strips having ends being arranged close to a first side of said substrate, said strips extending in a direction perpendicular to said first side of said substrate;

a plurality of first terminals electrically connected to said ends of said first electrodes and arranged substantially parallel to and in close proximity to said first side of said substrate;

a plurality of second electrodes having parallel strips having ends arranged close to a second side of said substrate, said second electrode being disposed orthogonally with respect to said first electrodes to define pixels at intersections between said first and second electrodes, said second side of said substrate being perpendicular to said first side of said substrate;

a second electrode passivation layer provided on a surface of said second electrodes on an opposite side of said first electrodes with respect to said second electrodes;

a plurality of second electrode leading members provided on a surface of said second electrode passivation layer on an opposite side of said second electrodes with respect to said second electrode passivation layer to be electrically connected to said second electrodes, said second electrode leading members having ends arranged close to said first side of said substrate; and a plurality of second terminals electrically connected to said ends of said second electrodes leading members, and arranged substantially parallel to and in close proximity to said first side of said substrate.

2. The matrix-addressed display device according to claim 1, said second electrode passivation layer having through-holes disposed therein, and said second electrode leading members being electrically connected to said second electrodes through said through-holes.

3. The matrix-addressed display device according to claim 1, said first terminals being provided on said ends of said first electrodes.

4. The matrix-addressed display device according to claim 1, said second terminals being provided on said ends of said second electrode leading members.

5. The matrix-addressed display device according to claim 1, said second electrode leading members being electrically connected to ends of said second electrodes at a circumferential side of said second electrode passivation layer.

6. The matrix-addressed display device according to claim 4, wherein said second electrode leading members include parallel parts extending parallel to said second electrodes and having ends electrically connected to said ends of said second electrodes at said circumferential side of said second electrode passivation layer, and perpendicular parts extending perpendicularly to said second electrodes having other ends substantially parallel to and in close proximity to said first side of said substrate.

7. The matrix-addressed display device according to claim 1, further comprising:

a screen, wherein said first electrodes are divided into first and second groups of first electrodes to divide said screen into two display areas by a line parallel to said first side of said substrate, said first group of first electrodes having ends in proximity to said first side of said substrate, said second group of first electrodes having ends in proximity to a third side of said substrate, said third side of said substrate being parallel to and opposite of said first side of said substrate;

a first electrode passivation layer provided on a surface of said first electrodes on an opposite side of said second electrodes with respect to said first electrodes;

a plurality of first electrode leading members provided on a surface of said first electrode passivation layer on an opposite side of said first electrodes with respect to said first electrode passivation layer, said first electrode leading members being electrically connected to said second group of said first electrodes and having ends arranged in close proximity to said first side of said substrate; and a plurality of third terminals electrically connected to said ends of said first electrode leading members and arranged in close proximity to said first side of said substrate.

8. The matrix-addressed display device according to claim 5, said first electrode passivation layer having through-holes disposed therein, and said first electrode leading members are electrically connected to said second group of said first electrodes through said through-holes.

9. The matrix-addressed display device according to claim 5, said third terminals being provided on said ends of said first electrode leading members.

10. The matrix-addressed display device according to claim 9, said third terminals being aligned substantially parallel to said first side of said substrate.

11. The matrix-addressed display device according to claim 5, wherein said first electrodes are data electrodes, and said second electrodes are scanning electrodes.

12. A matrix-addressed display device, comprising:

a screen for displaying images;

a substrate, said substrate including a plurality of elements disposed thereon, said elements comprising:

a plurality of data electrodes having parallel strips and divided into first and second groups of data electrodes to divide said screen into two display areas, said first and second groups of data electrodes extending in a direction perpendicular to first and second sides of said substrate, said first and second sides of said substrate being opposite each other, said first group of data electrodes having ends in close proximity to said first side of said substrate, said second group of data electrodes having ends in close proximity to said second side of said substrate;

a plurality of scanning electrodes having parallel strips and orthogonally provided with respect to said data electrodes to define pixels at intersections between said data electrodes and said scanning electrodes;

a passivation layer provided on a surface of said data electrodes on an opposite side of said scanning electrodes with respect to said data electrodes;

plurality of leading members provided on a surface of said passivation layer on an opposite side of said data electrodes with respect to said passivation layer to be electrically connected to said second group of data electrodes, and having ends arranged in close proximity to said first side of said substrate;

a plurality of first terminals provided on and electrically connected to said ends of said first group of data electrodes and arranged substantially parallel to and in close proximity to said first side of said substrate; and a plurality of second terminals provided on and electrically connected to said ends of said leading members and arranged substantially parallel to and in close proximity to said first side of said substrate to be insulated from said first terminals.

13. The matrix-addressed display device according to claim 10, said passivation layer having through-holes disposed therein and said leading members being electrically connected to said second group of data electrodes through said through-holes.

14. The matrix-addressed display device according to claim 10, said leading members are electrically connected to said second group of data electrodes at a circumferential side of said passivation layer.

15. The matrix-addressed display device according to claim 5, wherein said first electrodes, said second electrodes, said first electrode leading members, and said second electrode leading members being made of optically transparent material.

16. The matrix-addressed display device according to claim 10, wherein said data electrodes, scanning electrodes, said leading members are made of optically transparent material.

17. A matrix-addressed display device, comprising:

a substrate;

a plurality of first electrodes disposed on said substrate and extending parallel to each other, said first electrodes having a plurality of ends arranged on one side of said substrate;

a plurality of second electrodes extending parallel to each other and orthogonally to said first electrodes to define pixels at intersections between said first electrodes and said second electrodes;

a passivation layer disposed on said second electrodes on a side opposite said first electrodes;

a plurality of second electrode leading members disposed on said passivation layer on a side opposite said second electrodes, each said second electrode leading member being electrically connected to a corresponding one of said second electrodes, said second electrode leading members having a plurality of first and second ends, said plurality of first ends arranged on said one side of said substrate;

a plurality of first terminals electrically connected to said ends of said first electrodes; and a plurality of second terminals electrically connected to said first ends of said second electrode leading members, wherein said first terminals and said second terminals are arranged parallel to each other on said one side of said substrate.

18. The matrix-addressed display device according to claim 15, wherein said second electrode leading members include a plurality of segments extending in parallel to said first electrodes.

19. The matrix-addressed display device according to claim 15, wherein said passivation layer has a plurality of through-holes for connecting said second electrodes and said second electrode leading members therethrough.

20. The matrix-addressed display device according to claim 17, wherein each of said second electrode leading members has an L-like shape, a first part extending parallel to said second electrodes, and a second part extending parallel to said first electrodes and having a corresponding one of said first ends.

* * * * *